United States Patent [19]

Jedzinak

[11] 4,124,521

[45] Nov. 7, 1978

[54] SOAPS CONTAINING ENCAPSULATED OILS

[75] Inventor: John E. Jedzinak, Suffern, N.Y.

[73] Assignee: Revlon, Inc., New York, N.Y.

[21] Appl. No.: 838,630

[22] Filed: Oct. 3, 1977

Related U.S. Application Data

[63] Continuation-in-part of Ser. No. 749,040, Dec. 9, 1976, abandoned, which is a continuation-in-part of Ser. No. 595,871, Jul. 14, 1975, abandoned.

[51] Int. Cl.[2] ..... C11D 9/48; C11D 9/26; C11D 17/04

[52] U.S. Cl. ..... 252/127; 252/92; 252/122; 252/126; 252/132; 252/134; 252/DIG. 16

[58] Field of Search ..... 252/92, 132, 134, 316, 252/DIG. 16, 126, 127, 122; 424/32, 37

[56] References Cited

U.S. PATENT DOCUMENTS

| | | | |
|---|---|---|---|
| 3,516,937 | 6/1970 | Story et al. | 252/316 |
| 3,520,971 | 7/1970 | Benford | 252/316 |
| 3,576,760 | 4/1971 | Gould et al. | 252/134 X |
| 3,705,102 | 12/1972 | Mast | 252/316 |
| 3,798,179 | 3/1974 | Hellyer | 252/316 |
| 3,814,698 | 6/1974 | Ferrara et al. | 252/370 |

*Primary Examiner*—Harris A. Pitlick
*Attorney, Agent, or Firm*—Leon E. Tenenbaum

[57] ABSTRACT

A soap bar having substantially uniformly distributed therein microcapsules containing an oleophilic substance.

8 Claims, No Drawings

SOAPS CONTAINING ENCAPSULATED OILS

This application is a continuation-in-part of patent application Ser. No. 749,040, filed Dec. 9, 1976, now abandoned which is a continuation-in-part of patent application Ser. No. 595,871, filed July 14, 1975, now abandoned.

This invention relates to soaps containing oils, and it particularly relates to soap bars containing oils which have been encapsulated.

Soaps, such as salts of long chain fatty acids, usually obtained by the saponification of fats, and synthetic detergents, have defatting properties and as a result have a drying effect on the skin. There have been many attempts to overcome or to counteract this undesirable property of soaps. Most of these attempts have involved the inclusion within the soap of oleophilic substances in the free state. These substances are deposited on the skin of the user thus either preventing the loss of the natural fats present in the skin or replacing the fats that were lost during washing. However, although the inclusion in soap of oleophilic substances such as, for example fatty acid esters lanolin oils and the like, does reduce the drying effect of the soap on the skin, these oleophilic substances reduce the lather forming property of the soap. Furthermore, only a small amount of an oleophilic substance of the type illustrated can be included in a stable soap composition and frequently such small amounts are themselves emulsified by the soap preventing the deposition of an adequate amount of the oleophilic substance coating on the skin.

While soaps containing therein large amounts of oleophilic substances have been prepared (U.S. Pat. No. 3,814,698), such soaps have additional undesirable properties besides the reduction in sudsing and lathering. Such soaps are rather soft and become softer with increased use, making the bars difficult and uncomfortable to use and handle. In addition, this softness results in a loss of soap, as can be demonstrated by the slough test. In addition, such soaps, when used, have a slimy feeling which users find objectionable.

Besides the above-mentioned undesirable properties of soaps containing therein free oleophilic substances, the fabrication of such soaps presents problems. The soap-oleophilic substance composition is somewhat soft and mushy resulting in difficulties in processing the preparation through the plodding, molding and stamping steps.

It is, accordingly, an object of the present invention to provide a soap bar containing therein an oleophilic substance which composition can be prepared without difficulty due to its softness.

It is another object of the present invention to provide a soap bar having therein an oleophilic substance in an amount sufficient to provide a coating of said oleophilic substance on the skin.

It is a further object of the present invention to provide a soap bar having therein an oleophilic substance which substance is in such form as to interfere minimally with the lathering of the soap.

It is still another object of the present invention to provide a soap bar having therein an oleophilic substance which soap will produce a noticeable lubricious softening effect on the skin and still have good cleansing properties.

It is still a further object of the present invention to provide a soap bar that is hard and will not become soft and mushy during its use.

In accordance with the present invention there is provided a soap bar having substantially uniformly distributed therein a microencapsulated oleophilic substance in a concentration of from about 0.5 to 40% by weight of the soap composition. Preferably, the microencapsulated oleophilic substance is present in a concentration of from about 1 to 30% by weight of the soap composition, and more preferably from about 3 to 20%.

Any non-toxic, liquid oleophilic substance may be enclosed in the microcapsules. Suitable oleophilic substances include fatty acid esters such as isopropyl myristate, ethyl oleate, isopropyl palmitate, and the like, lanolin derivatives such as lanolin alcohol, liquid esters of lanolin alcohols, liquid ethers of lanolin alcohol, and the like, vegetable oils which are principally triglycerides of fatty acids, glyceryl esters of fatty acids such as glyceryl laurate, glyceryl myristate, glycerl coconate, glyceryl dilaurate, glyceryl trilaurate, glyceryl oleate, glyceryl palmitate, glycerly stearate and the like, and liquid saturated and unsaturated hydrocarbons such as mineral oil.

The encapsulating material may be any one of the standard materials used for forming the matrix of a microcapsule, such as, for example, starch-dextrin combinations, gum arabic, ureaformaldehyde, gelatin and the like. The matrix material may be of either the pressure sensitive or water-soluble type. The microcapsules may range in size from about 1 to 75 microns in diameter. Preferably, the diameter of the microcapsule is about 40 to 50 microns. The microcapsules may be prepared in the usual fashion about a base of the oleophilic material. These microcapsules preferably contain about 5 to 40% by weight of the oleophilic material.

As the preferred microencapsulated oleophilic material I use mineral oil encapsulated in gum arabic. These microcapsules have a diameter of about 44 microns and have a mineral oil content of about 40% by weight.

Hereinafter, soap base shall refer to the soap used in the soap composition of this invention. Suitable soap bases used in the soaps of the present invention are salts of fatty acids, usually alkali metal salts, obtained by the saponification of fats such as tallow, coconut fat, lard, and the like, or by the neutralization with an alkali such as sodium or potassium hydroxide, of fatty acids derived from such fats, salts of long chain saturated or unsaturated fatty acids such as sodium oleate, sodium palmitate, sodium myristate, potassium linoleate and the like, alkanolamides, isethionates, sarcosinates and the like. As the preferred material I use soap chips obtained by the saponification of an 80/20 blend of tallow and coconut fat, or by the neutrialization with alkali of a similar blend of fatty acids derived from these fats.

In preparing the soap bars of the present invention the desired amounts of the soap base and the microencapsulated oleophilic substance are thoroughly mixed in a blender and then passed into a soap plodder. The blend is then ground on a 3-roll mill and passed through a multiple orifice head attached to the plodder and this grinding and passage may be repeated. The material is then returned to the plodder and the soap composition is passed through a heater head attached to the plodder in which head the final billet of soap is formed. From the billet pieces of soap of desired size are cut and pressed into final shape. The heater is kept at a temperature of from about 45° to 90° C. If desired, other materials such as synthetic detergents, frangrances and colorants may be added to the soap base during blending. No problems are encountered in any of these steps.

The invention will be more fully understood from the examples which follow, which examples are given by way of illustration and are not to be considered as limiting.

EXAMPLE 1

990 grams of soap chips obtained by the saponification with sodium hydroxide of an 80/20 tallow/coconut fat were placed in a Sigma amalgamator and the mixer started. 10 grams of microcapsules of mineral oil in a matrix of gum arabic, said microcapsules containing about 40% by weight of the mineral oil and having a diameter of about 44 microns, were then added and the mixing continued until the blend was substantially uniform. The blend was then transferred to a soap plodder and twice passed through a multiple orifice head attached to the plodder. The material was then returned to the plodder and passed through a heater head attached to the plodder and kept at a temperature of 45° C. The billet of soap formed after passage through the heater head was then cut into bars of soap of desired size.

EXAMPLE 2

The process of Example 1 was repeated using 660 grams of the soap chips and 400 grams of the encapsulated mineral oil as were used in Example 1, but instead of being passed through the multiple orifice head, the blend was ground in a three-roller mill and then transferred to the plodder and passed through the heater head.

EXAMPLE 3

The process of Example 1 was repeated using 900 grams of the soap chips and 100 grams of the encapsulated mineral oil as were used in Example 1.

EXAMPLE 4

The process of Example 1 was repeated using 40 grams of sodium lauryl sulfate and 995 grams of the soap chips and 5 grams of the encapsulated mineral oil as was used in Example 1.

EXAMPLE 5

The process of Example 1 was repeated using 935 grams of the soap chips as described in Example 1, 40 grams of the encapsulated mineral oil as described in Example 1, and 25 grams of lemon fragrance oil. The fragrance was added to the mix immediately after the addition of the encapsulated mineral oil and the blending continued as described in Example 1.

EXAMPLE 6

The process of Example 1 was repeated using 50 grams of sodium lauryl sulfate and 940 grams of the soap chips and 100 grams of the encapsulated mineral oil as described in Example 1.

EXAMPLE 7

The process of Example 1 was repeated using 600 grams of the soap chips as was described in Example 1 and 400 grams of gelatin microcapsules containing about 35% by weight of lanolin alcohol and having a diameter of 40 microns.

EXAMPLE 8

| A soap formulation containing in parts by weight: | |
|---|---|
| Soap chips as described in Example 1 | 934.5 |
| Encapsulated mineral oil as described in Example 1 | 40.0 |
| Lavender fragrance | 25.0 |
| 25% Dispersion of D & C Violet #2 in propylene glycol | 0.5 |

The soap chips, encapsuled mineral oil and fragrance were blended till a uniform mix was obtained. The colorant was then added and the blending continued till the mix was uniform. The mixture was then transferred to the plodder and the procedure as described in Example 1 was followed.

As the soap bars prepared as described above as used, the microcapsules are ruptured as the soap is used, either by the pressure exerted on them or by the solution of the matrix in water, to release the free oleophilic substance in amounts which do not interfere with the lathering and cleansing properties of the soap.

After these soaps were used in washing hands, it was demonstrated that the hands were covered with a layer of the oleophilic substance. The soap bars were hard and retained their hardness during their entire periods of use.

I claim:

1. A soap bar consisting essentially of a soap base and an oleophilic substance, said base being an alkali metal salt of a fatty acid and said oleophilic substance being substantially uniformly distributed in said soap bar in the form of pressure sensitive or water-soluble microcapsules containing from about 5 to 40% by weight of the oleophilic substance, said capsules comprising about 0.5 to 40% by weight of the soap bar.

2. A soap bar according to claim 1, wherein the soap base is a saponified 80/20 mixture of tallow and coconut fat.

3. A soap bar according to claim 2, wherein the oleophilic substance is mineral oil or lanolin alcohol.

4. A soap bar according to claim 3, wherein the oleophilic substance is mineral oil.

5. A soap bar according to claim 4, wherein the mineral oil is encapsulated in gum arabic.

6. A soap bar according to claim 1, wherein the microcapsules are about 40–50 microns in diameter.

7. A soap bar according to claim 5, wherein the microcapsules are about 44 microns in diameter.

8. A soap bar according to claim 7, wherein the microcapsules contain about 40% by weight of mineral oil.

* * * * *